US010971099B2

(12) United States Patent
Zhao

(10) Patent No.: US 10,971,099 B2
(45) Date of Patent: Apr. 6, 2021

(54) DRIVING METHOD OF DISPLAY DEVICE, DATA DRIVING INTEGRATED CIRCUIT AND DISPLAY PANEL

(71) Applicants: HKC Corporation Limited, Guangdong (CN); Chongqing HKC Optoelectronics Technology Co., Ltd., Chongqing (CN)

(72) Inventor: Wenqin Zhao, Chongqing (CN)

(73) Assignees: HKC Corporation Limited, Shenzhen (CN); Chongqing HKC Optoelectronics Technology Co., Ltd., Chonqing (CN)

( * ) Notice: Subject to any disclaimer, the term of this patent is extended or adjusted under 35 U.S.C. 154(b) by 0 days.

(21) Appl. No.: 16/643,297

(22) PCT Filed: Jan. 11, 2018

(86) PCT No.: PCT/CN2018/072188
§ 371 (c)(1),
(2) Date: Feb. 28, 2020

(87) PCT Pub. No.: WO2019/041722
PCT Pub. Date: Mar. 7, 2019

(65) Prior Publication Data

US 2020/0258462 A1 Aug. 13, 2020

(30) Foreign Application Priority Data

Sep. 1, 2017 (CN) ..... 201710783384.2

(51) Int. Cl.
*G09G 3/36* (2006.01)

(52) U.S. Cl.
CPC ..... *G09G 3/3648* (2013.01); *G09G 3/3614* (2013.01); *G09G 2330/021* (2013.01)

(58) Field of Classification Search
CPC ..... G02F 1/13306; G09G 3/3688; G09G 2310/0291; G09G 3/3614; G09G 3/3696; G09G 3/36; G09G 3/3648; G09G 3/3685; G09G 2310/0297; G09G 2330/021; G09G 2330/045
See application file for complete search history.

(56) References Cited

U.S. PATENT DOCUMENTS 9,536,489 B2 * 1/2017 Song ..... G09G 3/3696
2014/0055697 A1 2/2014 Saitoh et al.
(Continued)

FOREIGN PATENT DOCUMENTS

CN 1674078 A 9/2005
CN 101551983 A 10/2009
(Continued)

*Primary Examiner* — Nelson M Rosario
(74) *Attorney, Agent, or Firm* — Muncy, Geissler, Olds & Lowe, P.C.

(57) ABSTRACT

A driving method of a display device, a data driving integrated circuit, and a display panel are provided. The driving method comprises: acquiring a voltage signal and a data polarity reversal signal to be transmitted; when the data polarity reversal signal is a predetermined level, comparing a voltage of the voltage signal with a predetermined drive voltage, and selecting a corresponding drive voltage according to a comparing result; and driving liquid crystal molecules according to the selected drive voltage.

13 Claims, 6 Drawing Sheets

(56) References Cited

U.S. PATENT DOCUMENTS

| | | | | |
|---|---|---|---|---|
| 2014/0132583 | A1* | 5/2014 | Kim | G09G 3/3233<br>345/212 |
| 2016/0055812 | A1* | 2/2016 | Kobayashi | G09G 3/3696<br>345/690 |

FOREIGN PATENT DOCUMENTS

| | | | |
|---|---|---|---|
| CN | 102831864 | A | 12/2012 |
| CN | 103310757 | A | 9/2013 |
| CN | 103578432 | A | 2/2014 |
| CN | 105630055 | A | 6/2016 |
| CN | 107331368 | A | 11/2017 |

* cited by examiner

DRIVING METHOD OF DISPLAY DEVICE, DATA DRIVING INTEGRATED CIRCUIT AND DISPLAY PANEL

BACKGROUND

Technical Field

This disclosure relates to the field of a display, and more particularly to a driving method of a display device, a data driving integrated circuit and a display panel.

Related Art

With the popularization of flat panel displays, the resolution is getting higher and higher, the size is getting larger and larger, the load on the data driver is getting higher and higher, and the voltage change frequency on a single data line drive channel is also getting higher and higher. According to the calculation of power consumption $P=\frac{1}{2}Cf(\Delta U)^2$ (where P represents the power consumption, C represents the panel's designed capacitor, and f represents the voltage change frequency on the data line), it is obtained that the power consumption of the data driver is getting higher and higher. Thus, the heating problem of the data driver becomes a bottleneck in designing the large-size, high-resolution liquid crystal displays.

SUMMARY

A main objective of this disclosure is to provide a driving method of a display device, a data driving integrated circuit and a display panel, which intend to solve the technical problems of the power consumption of the data driver in the existing art.

To achieve the above objective, the disclosure provides a driving method of a display device, comprising: acquiring a voltage signal and a data polarity reversal signal to be transmitted; when the data polarity reversal signal is a predetermined level, comparing a voltage of the voltage signal with a predetermined drive voltage, and selecting a corresponding drive voltage according to a comparing result; and driving liquid crystal molecules according to the selected drive voltage.

In one embodiment, the corresponding drive voltage comprises a first drive voltage and a second drive voltage, and the predetermined voltage comprises a first predetermined voltage. The step of when the data polarity reversal signal is the predetermined level, comparing the voltage of the voltage signal with the predetermined drive voltage, and selecting the corresponding drive voltage according to the comparing result comprises: when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

In one embodiment, before the voltage of the voltage signal is higher than the first predetermined voltage, the driving method comprises: acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

In one embodiment, the corresponding drive voltage comprises a third drive voltage and a fourth drive voltage, and the predetermined voltage comprises a second predetermined voltage. The driving method further comprises: when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

In one embodiment, before the step of judging whether the voltage of the voltage signal is higher than the second predetermined voltage or not, the driving method further comprises: acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

In addition, to achieve the above objective, the disclosure also provides a data driving integrated circuit comprising a signal acquiring module, a voltage selection module, and a liquid crystal drive module. The signal acquiring module acquires a voltage signal and a data polarity reversal signal to be transmitted. When the data polarity reversal signal is a predetermined level, the voltage selection module compares a voltage of the voltage signal with a predetermined drive voltage, and selects a corresponding drive voltage according to a comparing result. The liquid crystal drive module drives liquid crystal molecules according to the selected drive voltage.

In one embodiment, the corresponding drive voltage comprises a first drive voltage and a second drive voltage, and the predetermined voltage comprises a first predetermined voltage. The voltage selection module comprises a voltage judgment sub-module, when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

In one embodiment, the data driving integrated circuit further comprises a voltage acquiring module acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

In one embodiment, the corresponding drive voltage comprises a third drive voltage and a fourth drive voltage, and the predetermined voltage comprises a second predetermined voltage. The voltage selection module comprises a voltage judgment sub-module, when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

In one embodiment, the data driving integrated circuit further comprises a voltage acquiring module acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

To achieve the above objective, the disclosure further provides a display panel comprising the above-mentioned data driving integrated circuit.

This disclosure compares the voltage of the voltage signal with the predetermined drive voltage, and selects the corresponding drive voltage to drive the liquid crystal molecules according to the comparing result, thereby achieving the objective of reducing the power consumption.

The implement of objective, functional features and advantages of the disclosure will be further described in the embodiments with reference to the drawings.

DETAILED DESCRIPTION OF THE INVENTION

It should be understood that the following embodiments are for illustrations of this disclosure and are not to limit the scope of the disclosure.

Figure 1:
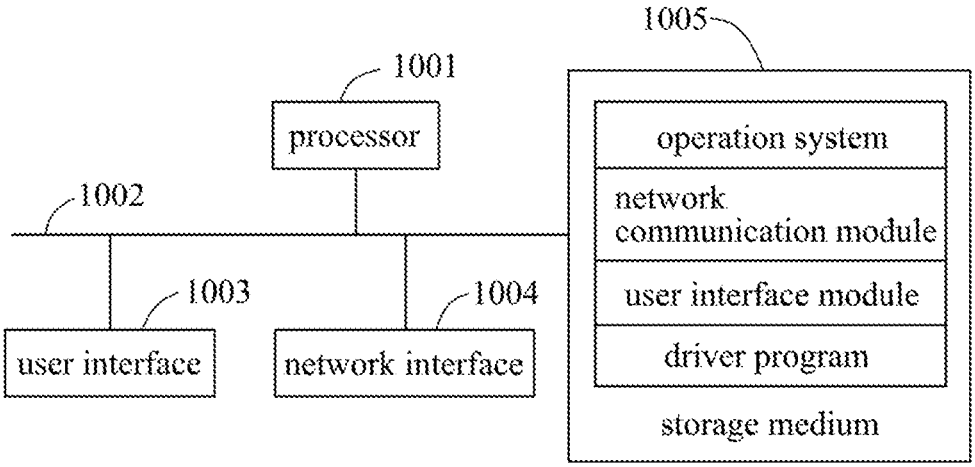
FIG. 1 is a schematic structure view showing a data driving integrated circuit of a hardware operating environment relating to an embodiment of this disclosure.

FIG. 1 is a schematic structure view showing a data driving integrated circuit of a hardware operating environment relating to an embodiment of this disclosure.

As shown in FIG. 1, a display panel includes a processor 1001, such as a central processing unit (CPU), a communication bus 1002, a user interface 1003, a network interface 1004 and a memory 1005. The communication bus 1002 achieves the connections and communications between these components. The user interface 1003 includes a display and an input unit such as a keyboard. The optional user interface 1003 may also include a standard wired interface and a wireless interface. The network interface 1004 may optionally include the standard wired interface and wireless interface (such as the WI-FI interface). The memory 1005 may be a high-speed RAM memory, and may also be a non-volatile memory, such as a disk memory. The memory 1005 may optionally be a storage device independent from the processor 1001.

Those skilled in the art will be appreciated that the structure of the display panel shown in FIG. 1 does not constitute a limitation on the display panel, and may include more or fewer components than the illustrated components, or some components may be combined, or different component layout may be adopted.

As shown in FIG. 1, the memory 1005 serving as a storage medium may include an operation system, a network communication module, a user interface module and a driver program.

In the display panel shown in FIG. 1, the network interface 1004 is mainly connected to the network, and communicates the data with the Internet. The user interface 1003 is mainly connected to a user terminal, and communicates the data with the terminal. The processor 1001 and the memory 1005 in the display panel of this disclosure may be disposed in the data driving integrated circuit, and the data driving integrated circuit calls the driver program stored in the memory 1005 through the processor 1001, and performs the following operations: acquiring a voltage signal and a data polarity reversal signal to be transmitted; when the data polarity reversal signal is a predetermined level, comparing a voltage of the voltage signal with a predetermined drive voltage, and selecting a corresponding drive voltage according to a comparing result; and driving liquid crystal molecules according to the selected drive voltage.

Further, the processor 1001 may call the driver program stored in the memory 1005, and also perform the following operations: when the data polarity reversal signal is a predetermined level, the voltage of the voltage signal is compared with the predetermined drive voltage, and the step of selecting the corresponding drive voltage according to the comparing result specifically includes: judging, when the data polarity reversal signal is a predetermined level, whether the voltage of the voltage signal is higher than the first predetermined voltage; selecting, when the voltage of the voltage signal is higher than the first predetermined voltage, the first drive voltage to drive the liquid crystal molecules; selecting, when the voltage of the voltage signal is lower than the first predetermined voltage, the second drive voltage to drive the liquid crystal molecules; and selecting, when the voltage of the voltage signal is equal to the first predetermined voltage, the second drive voltage to drive the liquid crystal molecules.

Further, the processor 1001 may adopt the driver program stored in the memory 1005, and also perform the following operations. Before the voltage of the voltage signal is higher than first predetermined voltage, the method includes: acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

Further, the processor 1001 may adopt the driver program stored in the memory 1005, and also perform the following operations. The corresponding drive voltage comprises a third drive voltage and a fourth drive voltage, and the predetermined voltage comprises a second predetermined voltage. The driving method further comprises: when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

Further, the processor 1001 may adopt the driver program stored in the memory 1005, and also perform the following operations. Before the step of judging whether the voltage of the voltage signal is higher than the second predetermined voltage or not, the driving method further includes: acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

This disclosure compares the voltage of the voltage signal with the predetermined drive voltage, and selects the corresponding drive voltage to drive the liquid crystal molecules according to the comparing result, thereby achieving the objective of reducing the power consumption.

Based on the above-mentioned hardware structure, an embodiment of a driving method of the display device of this disclosure is provided.

Figure 2:
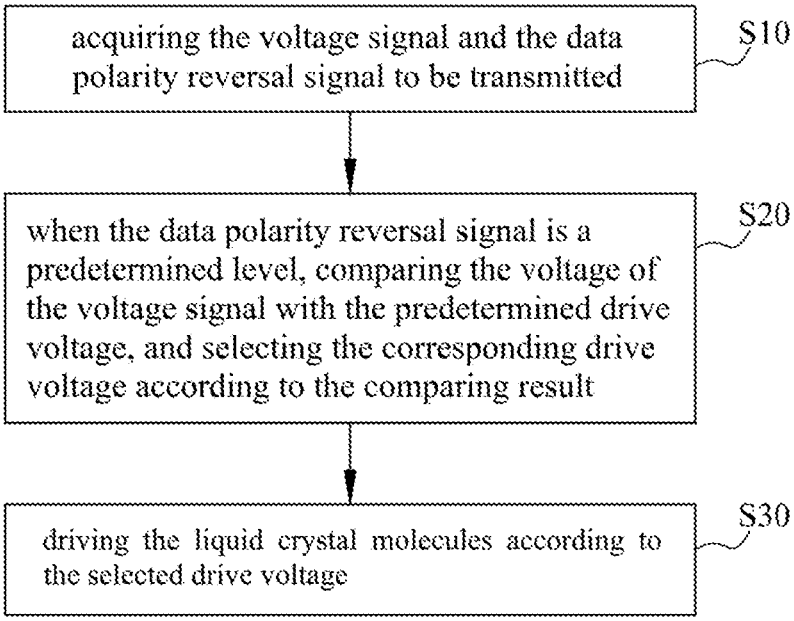
FIG. 2 is a schematic flow chart showing an embodiment of a driving method of the display device of this disclosure.

Please refer to FIG. 2. FIG. 2 is a schematic flow chart showing an embodiment of a driving method of the display device of this disclosure.

In the first embodiment, the driving method of the display device includes the following steps.

In a step S10, the voltage signal and the data polarity reversal signal to be transmitted are acquired.

It is to be described that this embodiment is mainly based on the data driving integrated circuit, the data driving integrated circuit mainly receives a digital video data signal and a control signal provided by the front end timing controller (TCON), the digital signal is conversed into the corresponding analog gray scale voltage signal through the digital-to-analog conversion, is inputted to the pixel of the liquid crystal display panel, drives the reversal of liquid crystal molecules, and achieves the change of the transmitted light brightness.

The voltage signal to be transmitted may be an analog gray scale voltage signal through the digital-to-analog conversion. The control signal includes the data polarity reversal signal (POL). Switching the high and low levels controls the polarity of the data signal outputted from the data line, and achieves the alternating drive of the liquid crystal.

Figure 3:
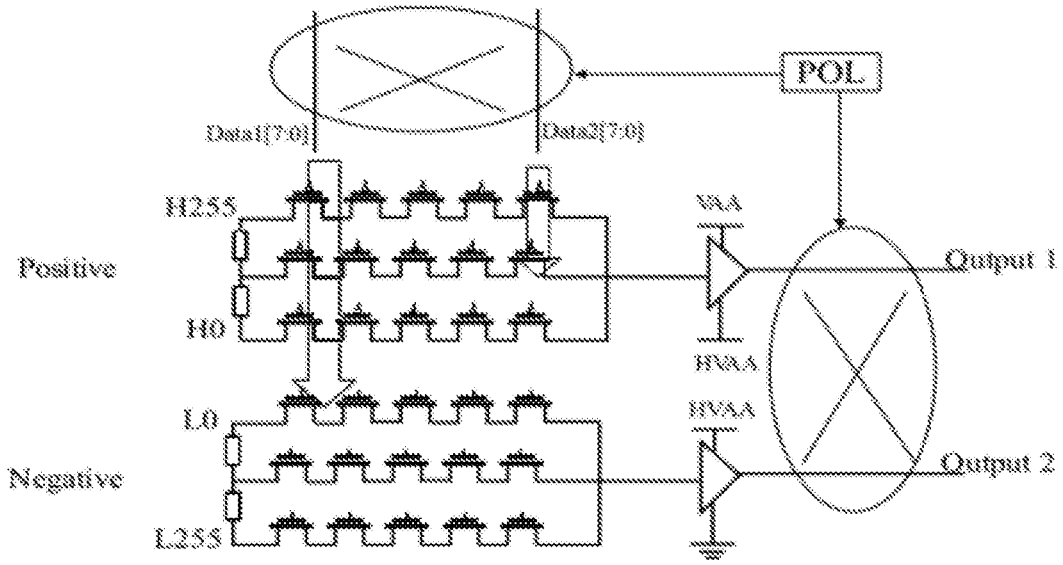
FIG. 3 is a schematic structure view showing an exemplary data driver.

FIG. 3 is a schematic structure view showing a data driver, which includes a positive polarity channel and a negative polarity channel, wherein Data[7:0] represents an 8-bit data signal of input, "output" represents an output terminal, VAA and HVAA represents the drive voltages, "Positive" represents the positive polarity channel, and "Negative" represents the negative polarity channel. The input data Data[7:0] may be transmitted to the output terminal through the positive polarity channel or the negative polarity channel. When the POL is the high level, the Data2[7:0] inputs the digital data voltage signal through the positive polarity channel, and outputs as the positive polarity gray scale voltage signal "output1" through the positive polarity channel. When the POL is the low level, the Data1[7:0] is transmitted to the negative polarity channel through the "Input MUX" switch to perform the data processing, is then transferred back to the "output1" channel through the "Output MUX" to output the positive polarity gray scale voltage signal after being processed. In other words, when the POL is the low level, the parallel digital data voltage signals are interchanged in the transmission channel.

In a step S20, when the data polarity reversal signal is a predetermined level, the voltage of the voltage signal is compared with the predetermined drive voltage, and the corresponding drive voltage is selected according to the comparing result.

In this embodiment, when the data polarity reversal signal is a predetermined level, selecting modules are disposed on two ends of the operational amplifier (OP), the judgement may be made according to the input voltage of the voltage signal, the appropriate voltage is selected to drive according to the judgment result, and the effect of reducing the power consumption is thus achieved. For example, the drive voltages of VAA-HVAAL and HVAAL-HVAA are provided on two ends of the OP, and the drive voltages are the drive voltages VAA, HVAA and HVAAL. When the liquid crystal molecules are driven, the drive voltage with the smaller voltage difference is selected, and the power consumption of the data driving integrated circuit is thus reduced.

FIG. 3 is a schematic structure view showing a data driver, which includes a positive polarity channel and a negative polarity channel, wherein Data[7:0] represents an 8-bit data signal of input, "output" represents an output terminal, VAA and HVAA represents the drive voltages, "Positive" represents the positive polarity channel, and "Negative" represents the negative polarity channel. The input data Data[7:0] may be transmitted to the output terminal through the positive polarity channel or the negative polarity channel. When the POL is the high level, the Data2[7:0] inputs the digital data voltage signal through the positive polarity channel, and outputs as the positive polarity gray scale voltage signal "output1" through the positive polarity channel. When the POL is the low level, the Data1[7:0] is transmitted to the negative polarity channel through the input switch to perform the data processing, is then transferred back to the "output1" channel through the output switch to output the positive polarity gray scale voltage signal after being processed. In other words, when the POL is the low level, the parallel digital data voltage signals are interchanged in the transmission channel.

Figure 4:
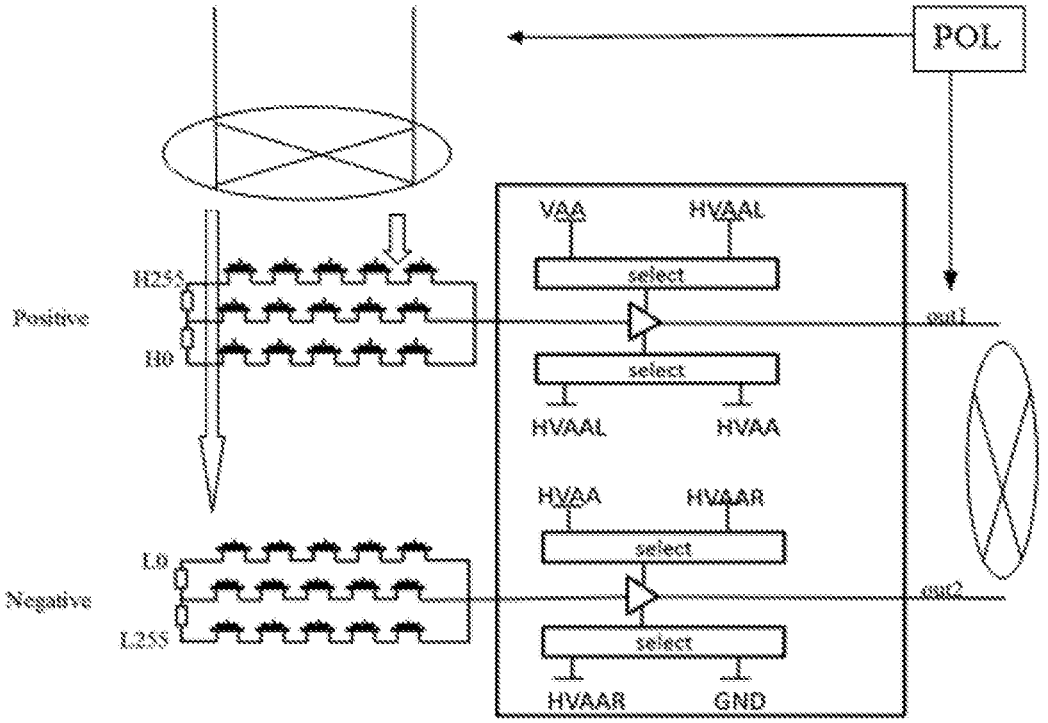
FIG. 4 is a schematic structure view showing a data driver of this disclosure.

In FIG. 4, after the digital data voltage signal is digital-to-analog converted, the analog voltage signal to be processed is obtained. After the analog voltage signal is buffered, selection voltages of the HVAAL and HVAAR are also provided in addition to the VAA and HVAA voltages provided in the buffer.

In order to keep the characteristics of liquid crystal molecules, the data polarity reversal signal (i.e., POL) is provided. When the POL is the predetermined level, values of the voltage of the voltage signal to be transmitted and the voltage to be selected are judged, and the appropriate drive voltage is selected to drive according to the comparing result, and the objective of reducing the power consumption is thus achieved.

In a step S30, the liquid crystal molecules are driven according to the selected drive voltage.

Under the normal circumstance, the drive voltage of VAA-HVAA is provided in the positive polarity channel. When the POL is the high level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of VAA-HVAAL is provided in the positive polarity channel. When the POL is the high level, the voltage of the voltage signal to be transmitted is judged as higher than that in the case of HVAAL, and the drive voltage of VAA-HVAAL is selected to drive the liquid crystal molecules. According to the power consumption calculating formula $P=\frac{1}{2}Cf(\Delta U)^2$ under the normal circumstance where VAA=2HVAA and HVAAL=¾VAA, the power consumption P2 in the limit case is:

$$P2=\tfrac{1}{2}Cf(\Delta U)^2=\tfrac{1}{2}Cf(VAA\text{-}HVAAL)^2=\tfrac{1}{2}Cf(\tfrac{1}{4}VAA)=\tfrac{1}{32}Cf(VAA)^2.$$

It is obtained that after the drive voltage is divided equally, the power consumption is reduced from the original $\frac{1}{8}Cf(VAA)^2$ to the $\frac{1}{32}Cf(VAA)^2$, that is, the power consumption is reduced to ¼ that of the original power consumption. Accordingly, the objective of reducing the power consumption can be achieved.

This disclosure compares the voltage of the voltage signal with the predetermined drive voltage, and selects the corresponding drive voltage to drive the liquid crystal molecules according to the comparing result, thereby achieving the objective of reducing the power consumption.

Figure 5:
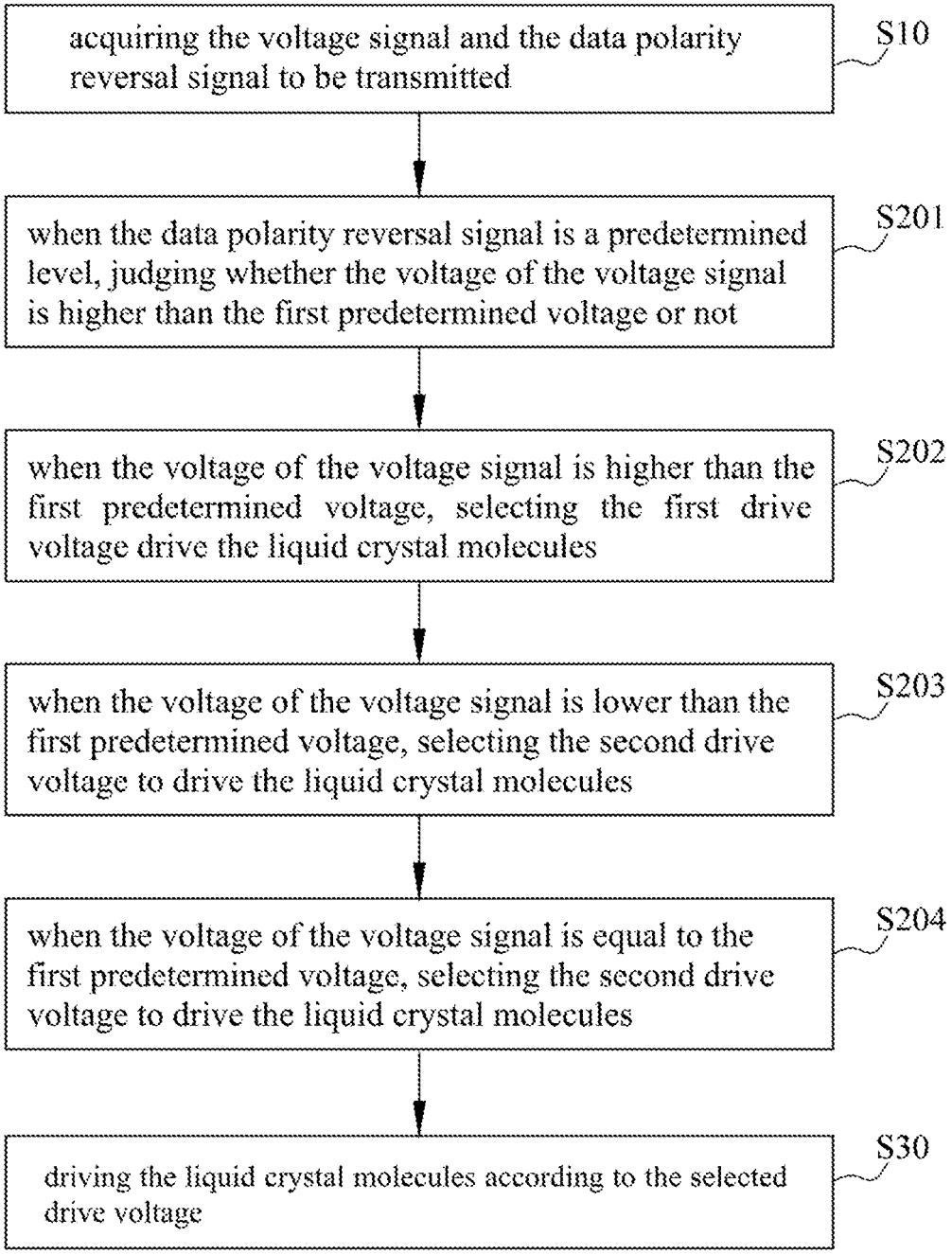
FIG. 5 is a schematic flow chart showing another embodiment of the driving method of the display device of this disclosure.

Further, as shown in FIG. 5, another embodiment of a driving method of the display device of this disclosure is provided based on one embodiment. In this embodiment, the corresponding drive voltage includes a first drive voltage and a second drive voltage, and the predetermined voltage includes a first predetermined voltage.

The step S20 specifically includes the following steps.

In a step S201, when the data polarity reversal signal is a predetermined level, it is judged whether the voltage of the voltage signal is higher than the first predetermined voltage.

In a step S202, when the voltage of the voltage signal is higher than the first predetermined voltage, the first drive voltage is selected to drive the liquid crystal molecules.

In a step S203, when the voltage of the voltage signal is lower than the first predetermined voltage, the second drive voltage is selected to drive the liquid crystal molecules.

In a step S204, when the voltage of the voltage signal is equal to the first predetermined voltage, the second drive voltage is selected to drive the liquid crystal molecules.

In this embodiment, illustrations will be made by taking the one half drive voltages as examples.

A first voltage range is acquired, a first predetermined voltage is selected according to the first voltage range, the average value of the maximum and minimum values in the first voltage range is taken as the first predetermined voltage, the voltage difference between the maximum value in the first voltage range and the first predetermined voltage is taken as the first drive voltage, and the voltage difference between the first predetermined voltage and the minimum value in the first voltage range is taken as the second drive voltage.

In order to achieve the objective of reducing the power consumption, the drive voltage range is divided into two equal portions drive voltage, so that when the voltage selection is performed, a more appropriate drive voltage may be selected. When the liquid crystal molecules are driven to reverse, the appropriate drive voltage is provided to drive, and the power consumption of the data driving integrated circuit is thus reduced. For example, the acquired voltage range is the drive voltage of VAA-HVAA, the average value HVAAL of the maximum and minimum values in the voltage range VAA-HVAA is taken as the first predetermined voltage, the voltage difference between the maximum value in the first voltage range and the first predetermined voltage is taken as the first drive voltage (i.e., VAA-HVAAL), and the voltage difference between the first predetermined voltage and the minimum value in the first voltage range is taken as the second drive voltage (i.e., VAAL-HVAA).

In the positive polarity channel, the HVAAL voltage is provided, and HVAAL is one half of the voltage between VAA and HVAA.

In order to keep the characteristics of liquid crystal molecules, the data polarity reversal signal (i.e., POL) is provided. When the POL is the high level (the predetermined level), the voltage signal to be transmitted performs the data processing through the positive polarity channel. In the positive polarity channel, the one half of the voltage of HVAAL (i.e., the drive voltages of VAA-HVAAL and HVAAL-HVAA) is provided, and the values of the voltage of the voltage signal to be transmitted and the voltage of HVAAL are judged. That is, when the voltage of the voltage signal is higher than that of the first predetermined level HVAAL, the first drive voltage VAA-HVAAL is selected to drive the liquid crystal molecules.

When the voltage of the voltage signal to be transmitted is lower than that of HVAAL, that is, when the voltage of the voltage signal is lower than or equal to the first predetermined voltage HVAAL, the drive voltage of HVAAL-HVAA is selected to drive the liquid crystal molecules.

This embodiment may further provide one third of the voltages HVAAL1 and HVAAL2 as examples.

In order to keep the characteristics of liquid crystal molecules, the data polarity reversal signal (i.e., POL) is provided. When the POL is the high level, the voltage signal to be transmitted performs the data processing through the positive polarity channel. In the positive polarity channel, the one third of the voltage of HVAAL (i.e., the drive voltages of VAA-HVAAL1, HVAAL1-HVAAL2 and HVAAL2-HVAA) is provided, and the values of the voltage of the voltage signal to be transmitted and the voltages of HVAAL1 and HVAAL2 are judged. When the voltage of the voltage signal to be transmitted is higher than that of HVAAL1, the drive voltage of VAA-HVAAL is selected to drive the liquid crystal molecules. When the voltage of the voltage signal to be transmitted is at the middle between HVAAL1 and HVAAL2, the drive voltage of HVAAL1-HVAAL2 is selected to drive the liquid crystal molecules. When the voltage of the voltage signal is lower than that of HVAAL2, the drive voltage of HVAAL2-HVAA is selected to drive the liquid crystal molecules.

The (1/n) drive voltages may also be provided, the principle is the same as that described hereinabove, and detailed descriptions thereof will be omitted herein.

In the practical application, however, because the drive voltage is divided into two equal portions, when the voltage selection is performed, the appropriate drive voltage may be selected more rapidly so that the response time of the data driving integrated circuit is shortened, and the work efficiency of the data driving integrated circuit is improved. Thus, in this embodiment, the processing based on one half of the drive voltage is described.

Under the normal circumstance, the drive voltage of VAA-HVAA is provided in the positive polarity channel. When the POL is the high level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of VAA-HVAAL is provided in the positive polarity channel. When the POL is the high level, the voltage of the voltage signal to be transmitted is judged as higher than that in the case of HVAAL, and the drive voltage of VAA-HVAAL is selected to drive the liquid crystal molecules. According to the power consumption calculating formula $P=\frac{1}{2}Cf(\Delta U)^2$ under the normal circumstance where VAA=2HVAA and HVAAL=¾VAA, the power consumption P2 in the limit case is:

$$P2=\tfrac{1}{2}Cf(\Delta U)^2=\tfrac{1}{2}Cf(VAA\text{-}HVAAL)^2=\tfrac{1}{2}Cf(\tfrac{1}{4}VAA)^2=\tfrac{1}{32}Cf(VAA)^2.$$

It is obtained that after the drive voltage is divided equally, the power consumption is reduced from the original $\frac{1}{8}Cf(VAA)^2$ to the $\frac{1}{32}Cf(VAA)^2$, that is, the power consumption is reduced to ¼ that of the original power consumption. Accordingly, the objective of reducing the power consumption can be achieved.

This embodiment drives the liquid crystal molecules by selecting the equally divided drive voltages, thereby achieving the objective of reducing the power consumption.

Figure 6:
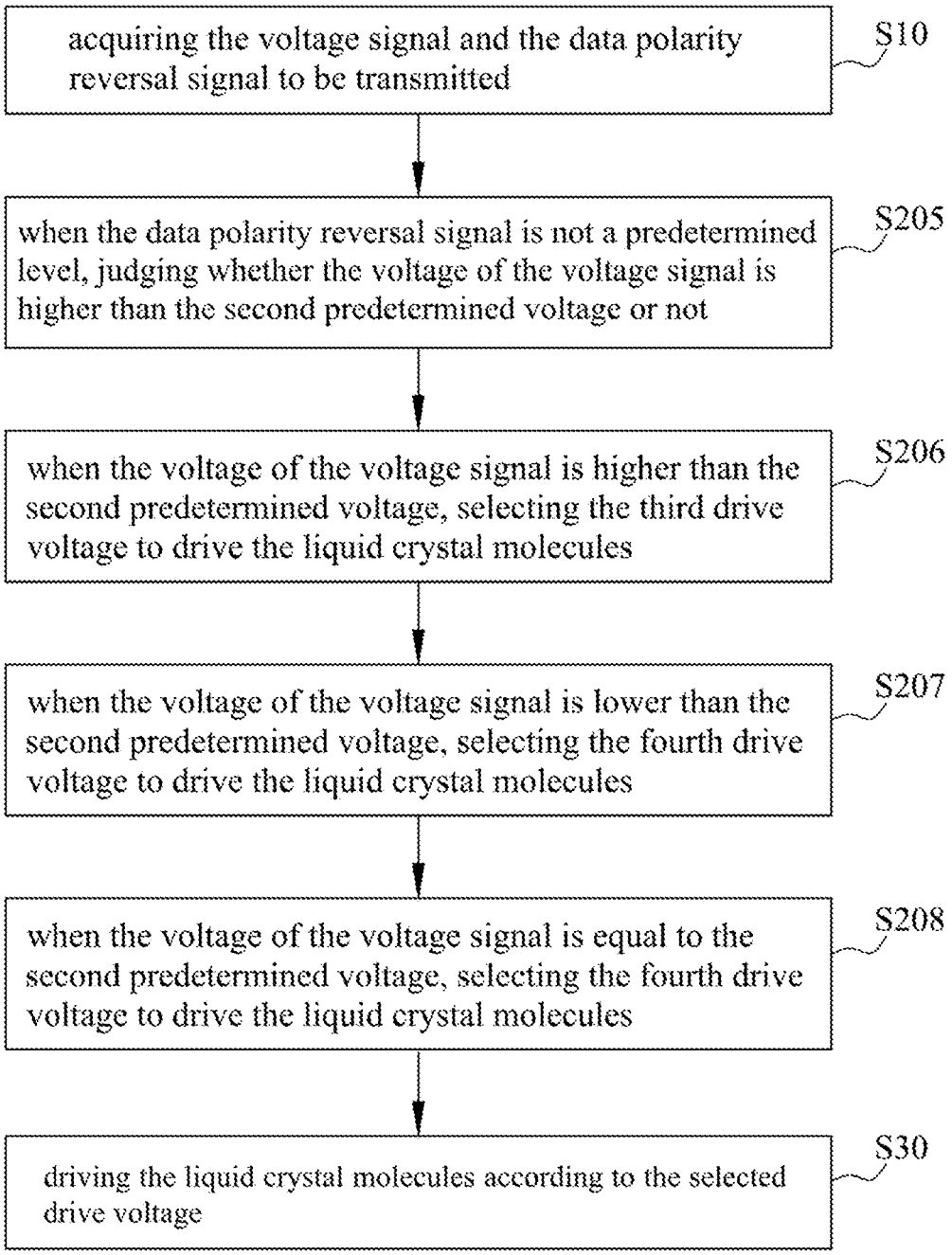
FIG. 6 is a schematic flow chart showing another embodiment of the driving method of the display device of this disclosure.

Further, as shown in FIG. 6, another embodiment of a driving method of display device of this disclosure is provided based on one embodiment. In this embodiment, the corresponding drive voltage includes a third drive voltage and a fourth drive voltage, and the predetermined voltage includes a second predetermined voltage.

The method further includes the following steps.

In a step S205, when the data polarity reversal signal is not a predetermined level, it is judged whether the voltage of the voltage signal is higher than the second predetermined voltage.

In a step S206, when the voltage of the voltage signal is higher than the second predetermined voltage, the third drive voltage is selected to drive the liquid crystal molecules.

In a step S207, when the voltage of the voltage signal is lower than the second predetermined voltage, the fourth drive voltage is selected to drive the liquid crystal molecules.

In a step S208, when the voltage of the voltage signal is equal to the second predetermined voltage, the fourth drive voltage is selected to drive the liquid crystal molecules.

In the negative polarity channel, the HVAAR voltage is provided, and the HVAAR is one half of the voltage between HVAA and GND.

It is to be described that (1/n) voltages between HVAA and GND may also be provided, where n is greater than 2. In this embodiment, the one half of the voltage HVAAR is provided as an example.

A second voltage range is acquired, the second predetermined voltage is selected according to the second voltage range, a voltage difference between a maximum value in the second voltage range and the second predetermined voltage is taken as the third drive voltage, and a voltage difference between the second predetermined voltage and a minimum value in the second voltage range is taken as the fourth drive voltage.

In order to achieve the objective of reducing the power consumption, the drive voltage range is divided into two equal portions drive voltage, so that when the voltage selection is performed, a more appropriate drive voltage may be selected. When the liquid crystal molecules are driven to reverse, the appropriate drive voltage is provided to drive, and the power consumption of the data driving integrated circuit is thus reduced. For example, the acquired voltage range is the drive voltage of HVAA-GND, the average value HVAAR of the maximum and minimum values in the voltage range HVAA-GND is taken as the second predetermined voltage, the voltage difference between the maximum value in the second voltage range and the second predetermined voltage is taken as the third drive voltage (i.e., HVAA-HVAAR), and the voltage difference between the second predetermined voltage and the minimum value in the second voltage range is taken as the fourth drive voltage (i.e., HVAAR-GND).

In this embodiment, illustrations will be made by taking the one half drive voltages as examples.

In order to keep the characteristics of liquid crystal molecules, the data polarity reversal signal (i.e., POL) is provided. When the POL is the low level (i.e., not the predetermined level), data processing is performed on the voltage signal to be transmitted through the negative polarity channel. In the negative polarity channel, the one half of the voltages of HVAAR (that is, the drive voltages of HVAA-HVAR and HVAAR-GND) are provided, and values of the voltage of the voltage signal to be transmitted and the voltage of HVAAR are judged. That is, when the voltage of the voltage signal is higher than the second predetermined voltage HVAAR, the drive voltage of HVAA-HVAAR is selected to drive the liquid crystal molecules; and when the voltage of the voltage signal to be transmitted is lower than or equal to HVAAR, the drive voltage of HVAAR-GND is selected to drive the liquid crystal molecules.

When the POL is the low level, data processing is performed on the voltage signal to be transmitted through the negative polarity channel. In the negative polarity channel, the one third of the voltages of HVAAR (i.e., the drive voltages of HVAA-HVAAR1, HVAAR1-HVAAR2 and HVAAR2-GND) are provided, and values of the voltage of the voltage signal to be transmitted and the voltages of HVAAR1 and HVAAR2 are judged. When the voltage of the voltage signal to be transmitted is higher than that of HVAAR1, the drive voltage of HVAA-HVAAR1 is selected to drive the liquid crystal molecules. When the voltage of the voltage signal to be transmitted is at the middle between HVAAR1 and HVAAR2, the drive voltage of HVAAR1-HVAAR2 is selected to drive the liquid crystal molecules. When the voltage of the voltage signal to be transmitted is lower than that of HVAAR2, the drive voltage of HVAAR2-GND is selected to drive the liquid crystal molecules.

The (1/n) drive voltages may also be provided, the principle is the same as that described hereinabove, and detailed descriptions thereof will be omitted herein.

In the practical application, however, because the drive voltage is divided into two equal portions, when the voltage selection is performed, the appropriate drive voltage may be selected more rapidly so that the response time of the data driving integrated circuit is shortened, and the work efficiency of the data driving integrated circuit is improved. Thus, in this embodiment, the processing based on one half of the drive voltage is described.

Under the normal circumstance, the drive voltage of HVAA-GND is provided in the positive polarity channel. When the POL is the low level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of HVAA-HVAAR is provided in the negative polarity channel. When the POL is the low level, the voltage of the voltage signal to be transmitted is judged as higher than that in the case of HVAAR, and the drive voltage of HVAA-HVAAR is selected to drive the liquid crystal molecules. According to the power consumption calculating formula $P=\frac{1}{2}Cf(\Delta U)^2$ under the normal circumstance where VAA=2HVAA and HVAAR=¼VAA, the power consumption P2 in the limit case is:

$$P2=\tfrac{1}{2}Cf(\Delta U)^2=\tfrac{1}{2}Cf(HVAA-HVAAR)^2=\tfrac{1}{2}Cf(\tfrac{1}{4}VAA)=\tfrac{1}{32}Cf(VAA)^2.$$

It is obtained that after the drive voltage is divided equally, the power consumption is reduced from the original $\frac{1}{8}Cf(VAA)^2$ to the $\frac{1}{32}Cf(VAA)^2$, that is, the power consumption is reduced to ¼ that of the original power consumption. Accordingly, the objective of reducing the power consumption can be achieved.

This embodiment drives the liquid crystal molecules by selecting the equally divided drive voltages, thereby achieving the objective of reducing the power consumption.

Figure 7:
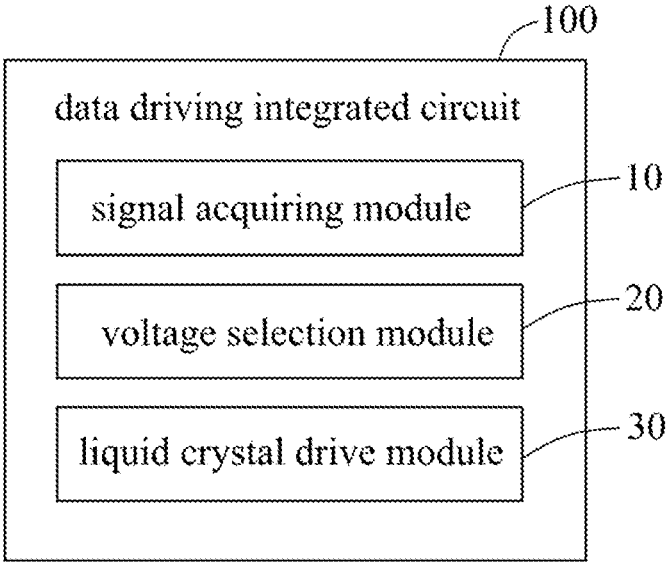
FIG. 7 is a schematic structure view showing an embodiment of the data driving integrated circuit of this disclosure.

FIG. 7 is a schematic structure view showing an embodiment of the data driving integrated circuit of this disclosure.

In an embodiment, as shown in FIG. 7, a data driving integrated circuit 100 includes a signal acquiring module 10, a voltage selection module 20 and a liquid crystal drive module 30. The signal acquiring module 10 acquires a voltage signal and a data polarity reversal signal to be transmitted. When the data polarity reversal signal is a predetermined level, the voltage selection module 20 compares a voltage of the voltage signal with a predetermined drive voltage, and selects a corresponding drive voltage according to a comparing result. The liquid crystal drive module 30 drives liquid crystal molecules according to the selected drive voltage.

It is to be described that this embodiment is mainly based on the data driving integrated circuit, the data driving integrated circuit mainly receives a digital video data signal and a control signal provided by the front end timing controller (TCON), the digital signal is conversed into the corresponding analog gray scale voltage signal through the digital-to-analog conversion, is inputted to the pixel of the liquid crystal display panel, drives the reversal of liquid crystal molecules, and achieves the change of the transmitted light brightness.

The voltage signal to be transmitted may be an analog gray scale voltage signal through the digital-to-analog conversion. The control signal includes the data polarity reversal signal (POL). Switching the high and low levels controls the polarity of the data signal outputted from the data line, and achieves the alternating drive of the liquid crystal.

FIG. 3 is a schematic structure view showing a data driver, which includes a positive polarity channel and a negative polarity channel, wherein Data[7:0] represents an 8-bit data signal of input, "output" represents an output terminal, VAA and HVAA represents the drive voltages, "Positive" represents the positive polarity channel, and "Negative" represents the negative polarity channel. The input data Data[7:0] may be transmitted to the output terminal through the positive polarity channel or the negative polarity channel. When the POL is the high level, the Data2[7:0] inputs the digital data voltage signal through the positive polarity channel, and outputs as the positive polarity gray scale voltage signal "output1" through the positive polarity channel. When the POL is the low level, the Data1[7:0] is transmitted to the negative polarity channel through the input switch to perform the data processing, is then transferred back to the "output1" channel through the output switch to output the positive polarity gray scale voltage signal after being processed. In other words, when the POL is the low level, the parallel digital data voltage signals are interchanged in the transmission channel.

In this embodiment, when the data polarity reversal signal is a predetermined level, selecting modules are disposed on two ends of the operational amplifier (OP), the judgement may be made according to the input voltage of the voltage signal, the appropriate voltage is selected to drive according to the judgment result, and the effect of reducing the power consumption is thus achieved. For example, the drive voltages of VAA-HVAAL and HVAAL-HVAA are provided on two ends of the OP, and the drive voltages are the drive voltages VAA, HVAA and HVAAL. When the liquid crystal molecules are driven, the drive voltage with the smaller voltage difference is selected, and the power consumption of the data driving integrated circuit is thus reduced.

FIG. 3 is a schematic structure view showing a data driver, which includes a positive polarity channel and a negative polarity channel, wherein Data[7:0] represents an 8-bit data signal of input, "output" represents an output terminal, VAA and HVAA represents the drive voltages, "Positive" represents the positive polarity channel, and "Negative" represents the negative polarity channel. The input data Data[7:0] may be transmitted to the output terminal through the positive polarity channel or the negative polarity channel. When the POL is the high level, the Data2[7:0] inputs the digital data voltage signal through the positive polarity channel, and outputs as the positive polarity gray scale voltage signal "output1" through the positive polarity channel. When the POL is the low level, the Data1[7:0] is transmitted to the negative polarity channel through the input switch to perform the data processing, is then transferred back to the "output1" channel through the output switch to output the positive polarity gray scale voltage signal after being processed. In other words, when the POL is the low level, the parallel digital data voltage signals are interchanged in the transmission channel.

In FIG. 4, after the digital data voltage signal is digital-to-analog converted, the analog voltage signal to be processed is obtained. After the analog voltage signal is buffered, selection voltages of the HVAAL and HVAAR are also provided in addition to the VAA and HVAA voltages provided in the buffer.

In order to keep the characteristics of liquid crystal molecules, the data polarity reversal signal (i.e., POL) is provided. When the POL is the predetermined level, values of the voltage of the voltage signal to be transmitted and the voltage to be selected are judged, and the appropriate drive voltage is selected to drive according to the comparing result, and the objective of reducing the power consumption is thus achieved.

In this embodiment, the drive voltage equally divided into two portions will be described.

Under the normal circumstance, the drive voltage of VAA-HVAA is provided in the positive polarity channel. When the POL is the high level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of VAA-HVAAL is provided in the positive polarity channel. When the POL is the high level, the voltage of the voltage signal to be transmitted is judged as higher than that in the case of HVAAL, and the drive voltage of VAA-HVAAL is selected to drive the liquid crystal molecules. According to the power consumption calculating formula $P=\frac{1}{2}Cf(\Delta U)^2$ under the normal circumstance where VAA=2HVAA and HVAAL=¾VAA, the power consumption P2 in the limit case is:

$$P2=\tfrac{1}{2}Cf(\Delta U)^2=\tfrac{1}{2}Cf(VAA\text{-}HVAAL)^2=\tfrac{1}{2}Cf(\tfrac{1}{4}VAA)=\tfrac{1}{32}Cf(VAA)^2.$$

This disclosure compares the voltage of the voltage signal with the predetermined drive voltage, and selects the corresponding drive voltage to drive the liquid crystal molecules according to the comparing result, thereby achieving the objective of reducing the power consumption.

This disclosure compares the voltage of the voltage signal with the predetermined drive voltage, and selects the corresponding drive voltage to drive the liquid crystal molecules according to the comparing result, thereby achieving the objective of reducing the power consumption.

Figure 8:
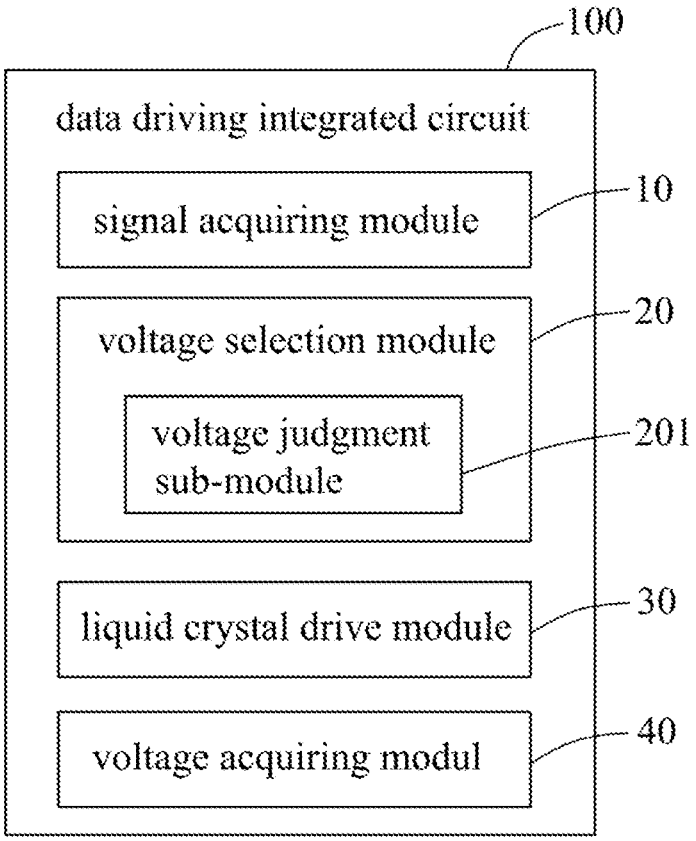
FIG. 8 is a schematic structure view showing another embodiment of the data driving integrated circuit of this disclosure.

Further, as shown in FIG. 8, another embodiment of a data driving integrated circuit of this disclosure is provided based on one embodiment. In this embodiment, the corresponding drive voltage includes a first drive voltage and a second drive voltage, and the predetermined voltage includes a first predetermined voltage.

The voltage selection module 20 includes a voltage judgment sub-module 201. When the data polarity reversal signal is the first predetermined level, it is judged whether the voltage of the voltage signal is higher than the first predetermined voltage.

The voltage selection module 20 further selects the first drive voltage to drive the liquid crystal molecules when the voltage of the voltage signal is higher than the first predetermined voltage.

The voltage selection module 20 further selects the second drive voltage to drive the liquid crystal molecules when the voltage of the voltage signal is lower than the first predetermined voltage.

The voltage selection module 20 further selects the second drive voltage to drive the liquid crystal molecules when the voltage of the voltage signal is equal to the first predetermined voltage.

In this embodiment, illustrations will be made by taking the one half drive voltages as examples.

The voltage acquiring module 40 acquires a first voltage range, selects a first predetermined voltage according to the first voltage range, takes the average value of the maximum and minimum values in the first voltage range as the first predetermined voltage, takes the voltage difference between the maximum value in the first voltage range and the first predetermined voltage as the first drive voltage, and takes the voltage difference between the first predetermined voltage and the minimum value in the first voltage range as the second drive voltage.

In order to achieve the objective of reducing the power consumption, the drive voltage range is divided into two equal portions drive voltage, so that when the voltage selection is performed, a more appropriate drive voltage may be selected. When the liquid crystal molecules are driven to reverse, the appropriate drive voltage is provided to drive, and the power consumption of the data driving integrated circuit is thus reduced. For example, the acquired voltage range is the drive voltage of VAA-HVAA, the average value of the maximum and minimum values in the voltage range is taken as the first predetermined voltage, the voltage difference between the maximum value in the first voltage range and the first predetermined voltage is taken as the first drive voltage (i.e., VAA-HVAAL), and the voltage difference between the first predetermined voltage and the minimum value in the first voltage range is taken as the second drive voltage (i.e., VAAL-HVAA).

In the positive polarity channel, the HVAAL voltage is provided, and HVAAL is one half of the voltage between VAA and HVAA.

In order to keep the characteristics of liquid crystal molecules, the data polarity reversal signal (i.e., POL) is provided. When the POL is the high level (the predetermined level), the voltage signal to be transmitted performs the data processing through the positive polarity channel. In the positive polarity channel, the one half of the voltage of HVAAL (i.e., the drive voltages of VAA-HVAAL and HVAAL-HVAA) is provided, and the values of the voltage of the voltage signal to be transmitted and the voltage of HVAAL are judged. That is, when the voltage of the voltage signal is higher than that of the first predetermined level HVAAL, the first drive voltage VAA-HVAAL is selected to drive the liquid crystal molecules.

When the voltage of the voltage signal to be transmitted is lower than or equal to that of HVAAL, that is, when the voltage of the voltage signal is lower than or equal to the first predetermined voltage HVAAL, the drive voltage of HVAAL-HVAA is selected to drive the liquid crystal molecules.

This embodiment may further provide one third of the voltages HVAAL1 and HVAAL2 as examples.

In order to keep the characteristics of liquid crystal molecules, the data polarity reversal signal (i.e., POL) is provided. When the POL is the high level, the voltage signal to be transmitted performs the data processing through the positive polarity channel. In the positive polarity channel, the one third of the voltage of HVAAL (i.e., the drive voltages of VAA-HVAAL1, HVAAL1-HVAAL2 and HVAAL2-HVAA) is provided, and the values of the voltage of the voltage signal to be transmitted and the voltages of HVAAL1 and HVAAL2 are judged. When the voltage of the voltage signal to be transmitted is higher than that of HVAAL1, the drive voltage of VAA-HVAAL is selected to drive the liquid crystal molecules. When the voltage of the voltage signal to be transmitted is at the middle between HVAAL1 and HVAAL2, the drive voltage of HVAAL1-HVAAL2 is selected to drive the liquid crystal molecules. When the voltage of the voltage signal is lower than that of HVAAL2, the drive voltage of HVAAL2-HVAA is selected to drive the liquid crystal molecules.

The (1/n) drive voltages may also be provided, the principle is the same as that described hereinabove, and detailed descriptions thereof will be omitted herein.

In the practical application, however, because the drive voltage is divided into two equal portions, when the voltage selection is performed, the appropriate drive voltage may be selected more rapidly so that the response time of the data driving integrated circuit is shortened, and the work efficiency of the data driving integrated circuit is improved. Thus, in this embodiment, the processing based on one half of the drive voltage is described.

Under the normal circumstance, the drive voltage of VAA-HVAA is provided in the positive polarity channel. When the POL is the high level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of VAA-HVAAL is provided in the positive polarity channel. When the POL is the high level, the voltage of the voltage signal to be transmitted is judged as higher than that in the case of HVAAL, and the drive voltage of VAA-HVAAL is selected to drive the liquid crystal molecules. According to the power consumption calculating formula $P=\frac{1}{2}Cf(\Delta U)^2$ under the normal circumstance where VAA=2HVAA and HVAAL=¾VAA, the power consumption P2 in the limit case is:

$$P2=\tfrac{1}{2}Cf(\Delta U)^2=\tfrac{1}{2}Cf(VAA-HVAAL)^2=\tfrac{1}{2}Cf(\tfrac{1}{4}VAA)=\tfrac{1}{32}Cf(VAA)^2.$$

It is obtained that after the drive voltage is divided equally, the power consumption is reduced from the original $\frac{1}{8}Cf(VAA)^2$ to the $\frac{1}{32}Cf(VAA)^2$, that is, the power consumption is reduced to ¼ that of the original power consumption. Accordingly, the objective of reducing the power consumption can be achieved.

This embodiment drives the liquid crystal molecules by selecting the equally divided drive voltages, thereby achieving the objective of reducing the power consumption.

Figure 9:
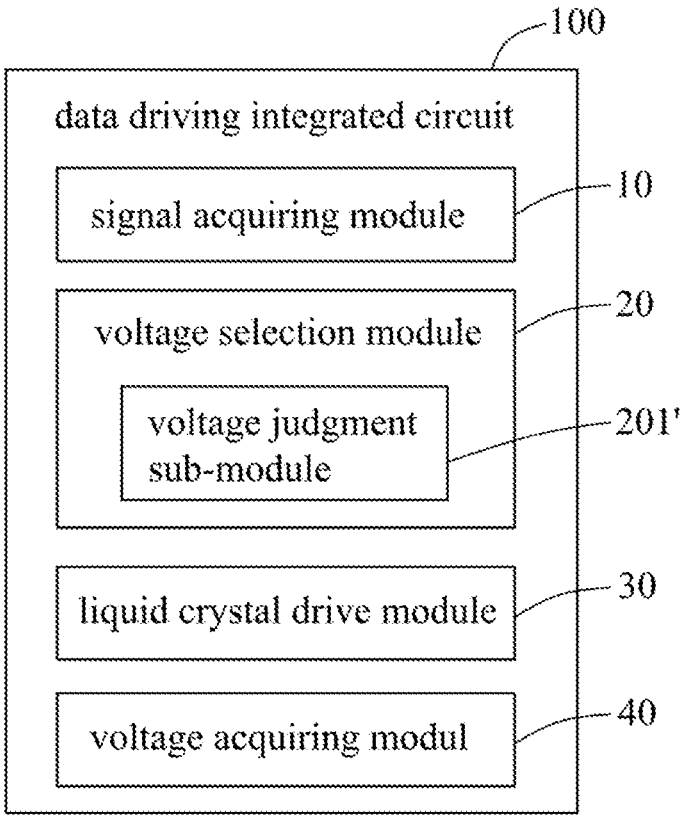
FIG. 9 is a schematic structure view showing another embodiment of the data driving integrated circuit of this disclosure.

Further, as shown in FIG. 9, another embodiment of a data driving integrated circuit of this disclosure is provided based on one embodiment. In this embodiment, the corresponding drive voltage includes a third drive voltage and a fourth drive voltage, and the predetermined voltage includes a second predetermined voltage.

The voltage selection module includes a voltage judgment sub-module 201'. When the data polarity reversal signal is not a predetermined level, the voltage judgment sub-module 201' judges whether the voltage of the voltage signal is higher than the second predetermined voltage.

When the voltage of the voltage signal is higher than the second predetermined voltage, the voltage judgment sub-module 201' selects the third drive voltage to drive the liquid crystal molecules.

When the voltage of the voltage signal is lower than the second predetermined voltage, the voltage judgment sub-module 201' selects the fourth drive voltage to drive the liquid crystal molecules.

When the voltage of the voltage signal is equal to the second predetermined voltage, the voltage judgment sub-module 201' selects the fourth drive voltage to drive the liquid crystal molecules.

In the negative polarity channel, the HVAAR voltage is provided, and the HVAAR is one half of the voltage between HVAA and GND.

It is to be described that (1/n) voltages between HVAA and GND may also be provided, where n is greater than 2. In this embodiment, the one half of the voltage HVAAR is provided as an example.

The voltage acquiring module 40 also acquires a second voltage range, a second predetermined voltage is selected according to the second voltage range, the average value of the maximum and minimum values in the second voltage range is taken as the second predetermined voltage, the voltage difference from the maximum value in the second voltage range and the second predetermined voltage is taken as the third drive voltage, and the voltage difference between the second predetermined voltage and the minimum value in the second voltage range is taken as the fourth drive voltage.

In order to achieve the objective of reducing the power consumption, the drive voltage range is divided into two equal portions drive voltage, so that when the voltage selection is performed, a more appropriate drive voltage may be selected. When the liquid crystal molecules are driven to reverse, the appropriate drive voltage is provided to drive, and the power consumption of the data driving integrated circuit is thus reduced. For example, the acquired voltage range is the drive voltage of HVAA-GND, the average value HVAAR of the maximum and minimum values in the voltage range HVAA-GND is taken as the second predetermined voltage, the voltage difference between the maximum value in the second voltage range and the second predetermined voltage is taken as the third drive voltage (i.e., HVAA-HVAAR), and the voltage difference between the second predetermined voltage and the minimum value in the second voltage range is taken as the fourth drive voltage (i.e., HVAAR-GND).

In this embodiment, illustrations will be made by taking the one half drive voltages as examples.

In order to keep the characteristics of liquid crystal molecules, the data polarity reversal signal (i.e., POL) is provided. When the POL is the low level (i.e., not the predetermined level), data processing is performed on the voltage signal to be transmitted through the negative polarity channel. In the negative polarity channel, the one half of the voltages of HVAAR (that is, the drive voltages of HVAA-HVAR and HVAAR-GND) are provided, and values of the voltage of the voltage signal to be transmitted and the voltage of HVAAR are judged. That is, when the voltage of the voltage signal is higher than the second predetermined voltage HVAAR, the drive voltage of HVAA-HVAAR is selected to drive the liquid crystal molecules; and when the voltage of the voltage signal to be transmitted is lower than or equal to HVAAR, the drive voltage of HVAAR-GND is selected to drive the liquid crystal molecules.

When the voltage of the voltage signal to be transmitted is lower than that of HVAAR, that is, when the voltage of the voltage signal is lower than or equal to the second predetermined voltage HVAAR, the drive voltage of HVAAR-GND is selected to drive the liquid crystal molecules.

When the POL is the low level, data processing is performed on the voltage signal to be transmitted through the negative polarity channel. In the negative polarity channel, one third of the voltages of HVAAR (i.e., the drive voltages of HVAA-HVAAR1, HVAAR1-HVAAR2 and HVAAR2-GND) are provided, and values of the voltage of the voltage signal to be transmitted and the voltages of HVAAR1 and HVAAR2 are judged. When the voltage of the voltage signal to be transmitted is higher than that of HVAAR1, the drive voltage of HVAA-HVAAR1 is selected to drive the liquid crystal molecules. When the voltage of the voltage signal to be transmitted is at the middle between HVAAR1 and HVAAR2, the drive voltage of HVAAR1-HVAAR2 is selected to drive the liquid crystal molecules. When the voltage of the voltage signal to be transmitted is lower than that of HVAAR2, the drive voltage of HVAAR2-GND is selected to drive the liquid crystal molecules.

The (1/n) drive voltages may also be provided, the principle is the same as that described hereinabove, and detailed descriptions thereof will be omitted herein.

In the practical application, however, because the drive voltage is divided into two equal portions, when the voltage selection is performed, the appropriate drive voltage may be selected more rapidly so that the response time of the data driving integrated circuit is shortened, and the work efficiency of the data driving integrated circuit is improved. Thus, in this embodiment, the processing based on one half of the drive voltage is described.

Under the normal circumstance, the drive voltage of VAA-HVAA is provided in the positive polarity channel. When the POL is the low level, the power consumption P1 in the limit case is obtained according to the power consumption calculating formula $P=\frac{1}{2}Cf(\Delta U)^2$ under normal circumstance where VAA=2HVAA, as:

$$P1=\tfrac{1}{2}Cf(\Delta U)^2=\tfrac{1}{2}Cf(HVAA)^2=\tfrac{1}{2}Cf(\tfrac{1}{2}VAA)^2=\tfrac{1}{8}Cf(VAA)^2.$$

In this embodiment, the drive voltage of HVAA-HVAAR is provided in the negative polarity channel. When the POL is the low level, the voltage of the voltage signal to be transmitted is judged as higher than that in the case of HVAAR, and the drive voltage of HVAA-HVAAR is selected to drive the liquid crystal molecules. According to the power consumption calculating formula $P=\frac{1}{2}Cf(\Delta U)^2$ under the normal circumstance where VAA=2HVAA and HVAAR=¼VAA, the power consumption P2 in the limit case is:

$$P2=\tfrac{1}{2}Cf(\Delta U)^2=\tfrac{1}{2}Cf(HVAA\text{-}HVAAR)^2=\tfrac{1}{2}Cf(\tfrac{1}{4}VAA)=\tfrac{1}{32}Cf(VAA)^2$$

It is obtained that after the drive voltage is divided equally, the power consumption is reduced from the original $\frac{1}{8}Cf(VAA)^2$ to the $\frac{1}{32}Cf(VAA)^2$, that is, the power consumption is reduced to ¼ that of the original power consumption. Accordingly, the objective of reducing the power consumption can be achieved.

This embodiment drives the liquid crystal molecules by selecting equally divided drive voltages, and the objective of reducing the power consumption is thus achieved.

In addition, the embodiment of this disclosure also provides a display panel, and the display panel includes the above-mentioned data driving integrated circuit.

Figure 10:
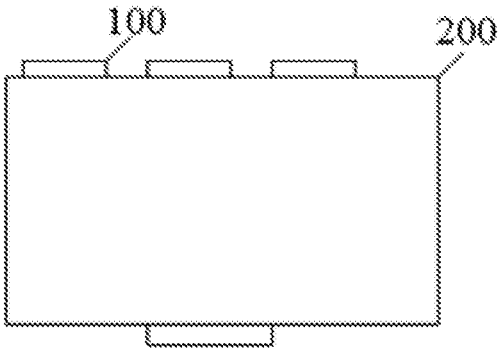
FIG. 10 is a schematic structure view showing a display panel of this disclosure.

As shown in FIG. 10, a display panel 200 includes the data driving integrated circuit 100.

In addition, the embodiment of this disclosure also provides a storage medium, a driver program is stored on the storage medium, and when the driver program is executed by the processor, the following operations are performed: acquiring a voltage signal and a data polarity reversal signal to be transmitted; when the data polarity reversal signal is a predetermined level, comparing a voltage of the voltage signal with a predetermined drive voltage, and selecting a corresponding drive voltage according to a comparing result; and driving liquid crystal molecules according to the selected drive voltage.

Further, when the driver program is executed by the processor, the following operations are performed: when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

Further, when the driver program is executed by the processor, the following operations are performed: acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

Further, when the driver program is executed by the processor, the following operations are performed: when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

Further, when the driver program is executed by the processor, the following operations are performed: acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

This embodiment compares the voltage of the voltage signal with the predetermined drive voltage, and selects the corresponding drive voltage to drive the liquid crystal molecules according to the comparing result, thereby achieving the objective of reducing the power consumption.

It is to be described that, in this context, the term "including", "comprising" or any other variant thereof is intended to encompass a non-exclusive inclusion such that the process, method, article or system including a series of elements includes not only those elements, but also other elements that are not explicitly listed, or those including elements inherent in such processes, methods, articles or systems. In the absence of more restrictions, the elements defined by the statement "including a . . . " do not preclude the existence of additional elements in the process, method, article, or system including the element.

The serial numbers of the above-mentioned embodiments of this disclosure are provided for the descriptive purpose only and are not representative of the good or bad properties of the embodiments.

With the description of the above-mentioned embodiments, it will be apparent to those skilled in the art that the methods of the above-mentioned embodiments maybe realized by means of software plus a necessary common hardware platform, and of course plus the hardware, but the former is a better implementation in many cases. Based on this understanding, the technical aspects of this disclosure may be embodied in the form of a software product, either essentially or in the form of contributions to the prior art. The computer software product is stored on a storage medium, such as ROM/RAM, disk, optical disk, including a number of instructions for enabling a terminal apparatus, which may be a mobile phone, a computer, a server, an air conditioner, a network device or the like, to perform the various embodiments of this disclosure.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a display device, comprising: acquiring a voltage signal and a data polarity reversal signal to be transmitted; when the data polarity reversal signal is a predetermined level, comparing a voltage of the voltage signal with a predetermined drive voltage, and selecting a corresponding drive voltage according to a comparing result; and driving liquid crystal molecules according to the selected drive voltage, wherein the corresponding drive voltage comprises a first drive voltage and a second drive voltage, and the predetermined voltage comprises a first predetermined voltage; the step of when the data polarity reversal signal is the predetermined level, comparing the voltage of the voltage signal with the predetermined drive voltage, and selecting the corresponding drive voltage according to the comparing result comprises: when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

2. The driving method according to claim 1, wherein before the voltage of the voltage signal is higher than the first predetermined voltage, the driving method comprises: acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

3. The driving method according to claim 1, wherein the corresponding drive voltage comprises a third drive voltage and a fourth drive voltage, and the predetermined voltage comprises a second predetermined voltage; the driving method further comprises: when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

4. The driving method according to claim 1, wherein before the step of judging whether the voltage of the voltage signal is higher than the second predetermined voltage or not, the driving method further comprises: acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

5. A data driving integrated circuit, comprising: a signal acquiring module acquiring a voltage signal and a data polarity reversal signal to be transmitted; a voltage selection module, wherein when the data polarity reversal signal is a predetermined level, the voltage selection module compares a voltage of the voltage signal with a predetermined drive voltage, and selects a corresponding drive voltage according to a comparing result; and a liquid crystal drive module driving liquid crystal molecules according to the selected drive voltage, wherein the corresponding drive voltage comprises a first drive voltage and a second drive voltage, the predetermined voltage comprises a first predetermined voltage, and the voltage selection module comprises: a voltage judgment sub-module, when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

6. The data driving integrated circuit according to claim 5, wherein the data driving integrated circuit further comprises: a voltage acquiring module acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

7. The data driving integrated circuit according to claim 5, wherein the corresponding drive voltage comprises a third drive voltage and a fourth drive voltage, the predetermined voltage comprises a second predetermined voltage, and the voltage selection module comprises: a voltage judgment sub-module, when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

8. The data driving integrated circuit according to claim 7, wherein the data driving integrated circuit further comprises: a voltage acquiring module acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

9. A display panel comprising the data driving integrated circuit of claim 5.

10. The display panel according to claim 9, wherein the corresponding drive voltage comprises a first drive voltage and a second drive voltage, the predetermined voltage comprises a first predetermined voltage, and the voltage selection module comprises: a voltage judgment sub-module, when the data polarity reversal signal is the predetermined level, judging whether the voltage of the voltage signal is higher than the first predetermined voltage; when the voltage of the voltage signal is higher than the first predetermined voltage, selecting the first drive voltage to drive the liquid crystal molecules; when the voltage of the voltage signal is lower than the first predetermined voltage, selecting the second drive voltage to drive the liquid crystal molecules; and when the voltage of the voltage signal is equal to the first predetermined voltage, selecting the second drive voltage to drive the liquid crystal molecules.

11. The display panel according to claim 10, wherein the data driving integrated circuit further comprises: a voltage acquiring module acquiring a first voltage range, selecting the first predetermined voltage according to the first voltage range, taking a voltage difference between a maximum value in the first voltage range and the first predetermined voltage as the first drive voltage, and taking a voltage difference between the first predetermined voltage and a minimum value in the first voltage range as the second drive voltage.

12. The display panel according to claim 9, wherein the corresponding drive voltage comprises a third drive voltage and a fourth drive voltage, the predetermined voltage comprises a second predetermined voltage, and the voltage selection module comprises: a voltage judgment sub-module, when the data polarity reversal signal is not a predetermined level, judging whether a voltage of the voltage signal is higher than the second predetermined voltage or not; when the voltage of the voltage signal is higher than the second predetermined voltage, selecting the third drive voltage to drive the liquid crystal molecules; when the voltage of the voltage signal is lower than the second predetermined voltage, selecting the fourth drive voltage to drive the liquid crystal molecules; and when the voltage of the voltage signal is equal to the second predetermined voltage, selecting the fourth drive voltage to drive the liquid crystal molecules.

13. The display panel according to claim 12, wherein the data driving integrated circuit further comprises: a voltage acquiring module acquiring a second voltage range, selecting the second predetermined voltage according to the second voltage range, taking a voltage difference between a maximum value in the second voltage range and the second predetermined voltage as the third drive voltage, and taking a voltage difference between the second predetermined voltage and a minimum value in the second voltage range as the fourth drive voltage.

* * * * *